US005876896A

United States Patent [19]

Suda et al.

[11] Patent Number: 5,876,896

[45] Date of Patent: Mar. 2, 1999

[54] LIQUID TONER COMPOSITION AND METHOD OF MANUFACTURING THE SAME

[75] Inventors: Yasuharu Suda; Hiroyoshi Kawamura; Hiroaki Kuno, all of Hiroshima-ken, Japan

[73] Assignee: Mitsubishi Heavy Industries, Ltd., Tokyo, Japan

[21] Appl. No.: 912,855

[22] Filed: Aug. 18, 1997

[30] Foreign Application Priority Data

Aug. 19, 1996 [JP] Japan ..... 8-217409
Aug. 19, 1996 [JP] Japan ..... 8-217411

[51] Int. Cl.[6] ..... G03G 9/16

[52] U.S. Cl. ..... 430/115

[58] Field of Search ..... 430/114, 115, 430/119

[56] References Cited

U.S. PATENT DOCUMENTS 4,289,678 9/1981 Calder et al. ..... 260/33.6
4,842,972 6/1989 Tavernier et al. ..... 430/119
4,917,986 4/1990 Chan et al. ..... 430/115
4,994,341 2/1991 Adair et al. ..... 430/115

FOREIGN PATENT DOCUMENTS 5134468 5/1993 Japan .

OTHER PUBLICATIONS

Sasazawa Tatsuya, Patent Abstracts of Japan, vol. 7, No. 67, (p. 184) Mar. 19, 1983 (Exhibit 2).

*Primary Examiner*—John Goodrow
*Attorney, Agent, or Firm*—John P. White; Cooper & Dunham LLP

[57] ABSTRACT

Disclosed is a liquid toner composition, comprising an ethylene-based copolymer resin, an ethylene-based copolymer resin, an electrically insulating liquid material, and a surfactant represented by general formula given below (1)

where R is an alkyl group or an alkylaryl group, n, which represents ad adduct ethyleneoxide mole number, is an integer of 4 to 13, and R' is H or $R(CH_2CH_2O)_n$ group.

7 Claims, 1 Drawing Sheet

LIQUID TONER COMPOSITION AND METHOD OF MANUFACTURING THE SAME

BACKGROUND OF THE INVENTION

The present invention relates to a liquid toner composition adapted for use in, particularly, an electrophotography, an electrostatic printing and an information recording.

The conventional liquid toner composition adapted for an electrophotography comprises in general an electrically insulating liquid material, coloring particles having a particle diameter of 0.1 to 1 $\mu$m and dispersed in the liquid material, and a resin soluble in the electrically insulating material and serving to disperse, fix and adjust the electrical charge of the coloring particles. Such a liquid toner is disclosed in Jpn. Pat. Appln. KOKAI Publication No. 5-134468.

The coloring particles contained in the liquid toner composition of this type have a small particle diameter, leading to an excellent resolution. In addition, the composition can be prepared relatively easily. On the other hand, the toner composition is poor in its fixing properties. If the composition is used over a long period of time while replenishing toner of a higher concentration, the image quality is rendered defective by the change in the concentration of the resin dissolved in the electrically insulating material.

To overcome the above-noted difficulty, proposed is a liquid toner composition prepared by dispersing particles, including colorant particles in some cases, of resin in an electrically insulating material, said resin being insoluble at room temperature in said electrically insulating liquid material. However, if the resin particles are prepared by polymerization, the reaction is restricted by various polymerizing conditions. In addition, in order to obtain a satisfactory liquid toner composition, it is necessary in some cases to remove the initiator, unreacted monomers, etc. attached to the surfaces of the resin particles after the polymerization. Further, where resin is once dissolved in a solvent under heat, followed by cooling the resultant solution to cause precipitation of resin particles, it is difficult to control as desired the particle diameter of the resin particles.

Under the circumstances, the present inventors previously developed an effective method and already filed a patent application for the particular method. In this method, an olefin resin is dissolved under heat in a solvent having a high temperature dependency in its capability of dissolving the resin and having its solubility parameter, hereinafter referred to as SP, adjusted to control as desired the diameter of the resin particles, followed by lowering the solubility of the resin in the resultant solution so as to obtain resin particles having a desired average particle diameter and a narrow range of the particle size distribution. Further, the present inventors have now developed a liquid toner composition containing the above-noted resin particles and adapted for producing a high quality image and also developed a method of manufacturing the composition, leading to the present invention.

BRIEF SUMMARY OF THE INVENTION

An object of the present invention is to provide a liquid toner composition containing resin particles having a desired average particle diameter and a narrow particle size distribution, the composition being capable of increasing the image density and forming images free from bleeding so as to improve the image quality.

According to a first aspect of the present invention, there is provided a liquid toner composition, comprising an ethylene-based copolymer resin, or a colorant-added ethylene-based copolymer resin, an electrically insulating liquid material, and a surfactant represented by general formula (1) given below:

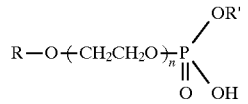

(1)

where R is an alkyl group or an alkylaryl group;

n is an integer of 4 to 13 indicating the moles of ethylene oxide added; and R' is H or $R(CH_2CH_2O)_n$ group.

According to a second aspect of the present invention, there is provided a method of manufacturing a liquid toner composition, comprising the steps of:

(a) dissolving under heat an ethylene-based copolymer resin or a colorant-added ethylene-based copolymer resin in a solvent having a high temperature dependency in its capability of dissolving the copolymer resin and having its solubility parameter SP adjusted to control as desired the diameter of the toner particles;

(b) cooling the resultant solution to precipitate toner particles; and (c) replacing the solvent with an electrically insulating liquid material so as to disperse the precipitated toner particles in the liquid material, wherein the steps (a) to (c) are carried out in the presence of a surfactant represented by the general formula (1) given previously.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of he invention.

FIG. 1 is a graph showing the particle size distribution of the toner particles obtained in Example of the present invention; and.

DETAILED DESCRIPTION OF THE INVENTION

Figure 1:
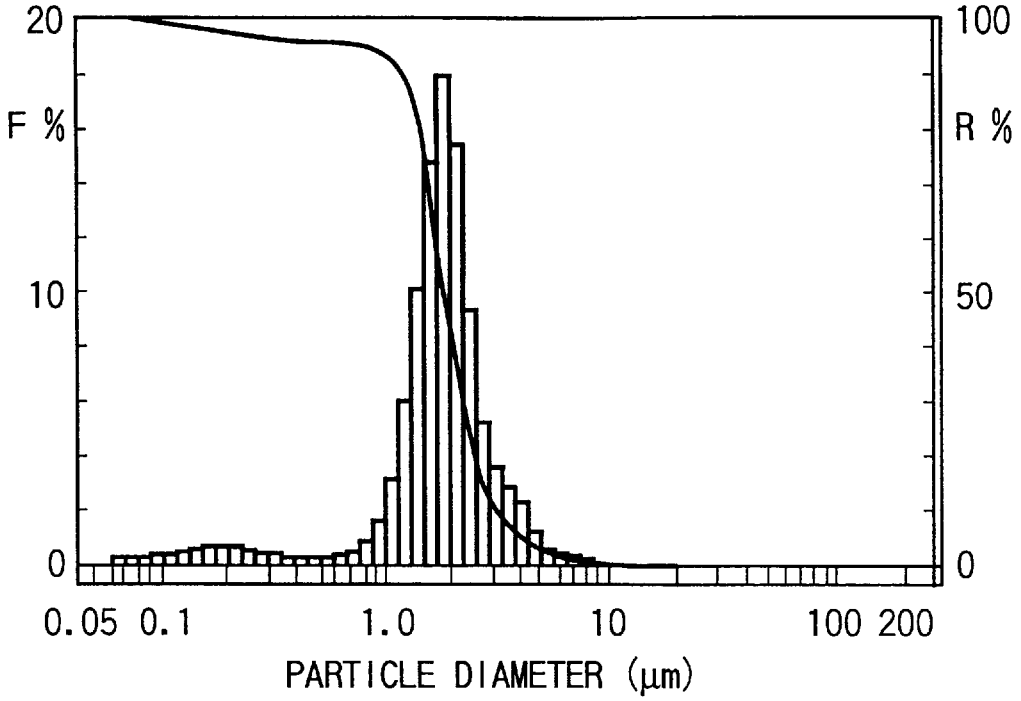

The liquid toner composition of the present invention contains at least components (A) to (D) given below:

(A) A nonpolar liquid material having an electrical resistivity of at least $10^9$ Ω·cm and a dielectric constant of at most 3.0.

(B) Particles of an ethylene-based resin or a colorant-added ethylene-based resin, which are insoluble in the nonpolar liquid material (A) at 50° C. or less and have a volume-based average particle diameter of at most 15 $\mu$m.

(C) A surfactant represented by the general formula (1) given previously.

(D) Metal salts of a mixture consisting of a saturated carboxylic acid having a five-membered ring and a saturated carboxylic acid having a plurality of ring structures, each of these carboxylic acids having an average molecular weight of 240 to 360 and having a compatibility with the nonpolar liquid material (A). The metal in these metal salts is selected from the group consisting of Co, Ca, Zn, Zr and Ba.

The ethylene-based copolymer resin used in the present invention includes, for example, ethylene-vinyl acetate copolymer, partially saponified ethylene-vinyl acetate copolymer, ethylene-acrylic acid copolymer, and ethylene-acrylic acid ester copolymer. These copolymer resins can be used singly or in the form of a mixture of a plurality of these copolymer resins.

The electrically insulating liquid material used in the present invention is required to have an electrical resistivity of at least $10^9$ Ω·cm and a dielectric constant of at most 3. It is desirable for the insulating liquid material to be substantially incapable of dissolving the ethylene-based copolymer resin at room temperature. The specific insulating liquid materials used in the present invention include, for example Isopar G, H, L and M (trade name of an electrically insulating liquid material manufactured by Exxon Chemical K.K.).

In manufacturing the liquid toner composition of the present invention, the ethylene-based copolymer resin is dissolved in step (a) in a solvent. It is necessary for particular solvent to be capable of dissolving the ethylene-based copolymer resin in the heating step and substantially incapable of dissolving the copolymer resin at room temperature. To be more specific, a difference between the solubility of the copolymer resin in the solvent at 25° C. and that at 60° C. should be at least 0.1 g/100 g of the solvent, preferably, at least 1 g/100 g of the solvent. Further, it is necessary to adjust the SP value of the solvent in order to control as desired the particle diameter of the precipitated resin particles. The diameter of the resin particles can be diminished with decrease in the difference ΔSP between the SP value of the resin itself and that of the solvent. The solvent used in the present invention includes, for example, a linear or branched aliphatic hydrocarbon, an aromatic hydrocarbon, and a linear or branched aliphatic alcohol having at most 10 carbon atoms. These compounds can be used singly or in the form of a mixture of a plurality of these compounds.

The surfactant used in the present invention is represented by general formula (1) given previously, wherein n is an integer falling within a range of between 4 and 13, and R denotes desirably a nonylphenyl group, an octylphenyl group, a dinonylphenyl group or a distyrylphenyl group. If n in formula (1) is smaller than 4, the surfactant fails to produce a sufficient effect of dispersing the resin particles, or the particle dispersing effect is markedly impaired. On the other hand, if n is larger than 13, the surfactant is rendered unduly hydrophilic, with the result that the surfactant is made compatible with the electrically insulating liquid material. The surfactant (C) represented by the general formula (1) may be added in the step of dispersing the pigment. Alternatively, the surfactant (C) may be added in the step of dissolving the resin under heat or cooling the heated solution to permit precipitation of the toner particles. Further, the surfactant (C) may be added in the step of replacing the solvent with the electrically insulating material for dispersion of the precipitated resin particles.

The liquid toner composition of the present invention may also contain a charge controller. It is possible to use the known charge controllers in the present invention including, for example, lecithin, linseed oil, a metal salt of a naphthenic acid (metal component of the salt being, for example, Co, Zn, Cu, Mn, Zr or Fe), a metal salt of octylic acid (metal component of the salt being, for example, Co or Zr), and zirconium isodecanate.

The nonpolar liquid material (A) contained in the liquid toner composition of the present invention includes, for example, a linear or branched aliphatic hydrocarbon, an alicyclic hydrocarbon and a halogenated derivative thereof. The specific nonpolar liquid material (A) includes, for example, octane, isooctane, decane, isodecane, dodecane, isododecane, Isopar G, Isopar H, Isopar L, Isopar M ("Isopar" being a trade name by Exxon Inc. as pointed out previously), cyclooctane and cyclodecane. These liquid materials can be used singly or in the form of a mixture of a plurality of these liquid materials. It is desirable for the nonpolar liquid material to have an electrical resistivity of at least $10^9$ Ω·cm. If the electrical resistivity is lower than the value noted above, the electrostatic latent image formed on the surface of a photosensitive body tends to be disturbed. Also, the nonpolar liquid material should desirably have a dielectric constant as small as possible in order to allow the charge in the photosensitive layer to provide an effective electrostatic field. Practically, the dielectric constant of the nonpolar liquid material should desirably be at most 3.0.

The ethylene-based resin used in the present invention includes, for example, a partially saponified ethylene-vinyl acetate copolymer, ethylene-acrylic acid copolymer and ethylene-acrylic acid ester copolymer. These copolymers can be used singly or in the form of a mixture of at least two of these copolymers.

Known dyes or pigments can be used in the present invention as a colorant, including, for example, carbon black such as channel black or furnace black; phthalocyanine-based pigment such as C.I. No. Pigment Blue 15, 15:1, 15:3, etc.; azo lake series of azo pigments such as Pigment Red 122; quinacridone series pigment such as Pigment Red 122; disazo pigment such as Pigment Yellow 12, 13, etc.; and monoazo pigment such as Pigment Yellow 1, 3, etc. The colorant may be added in advance to the ethylene-based copolymer resin by means of, for example, kneading under heat. Alternatively, the colorant may be added before precipitation of the resin particles during manufacture of the liquid toner composition.

In the present invention, the compound represented by general formula (1) given previously is used as the surfactant (C). It is desirable for R in general formula (1) to denote, for example, nonyphenyl, octylphenyl, dinonyphenyl or distyrylphenyl group, though R need not be limited to these groups. It should be noted that n in formula (1), i.e., the number of ethylene oxide adducts included in the compound of formula (1), is smaller than 4, the toner particle dispersion effect produced by the surfactant is markedly lowered. If n is larger than 13, however, the surfactant is rendered unduly hydrophilic, with the result that the surfactant is made compatible with the electrically insulating material. The surfactant (C) represented by general formula (1) may be added in the step of dispersing the pigment. Alternatively, the surfactant (C) may be added in the step of dissolving the resin under heat or cooling the heated solution to permit precipitation of the toner particles. Further, the surfactant (C) may be added in the step of replacing the solvent with the electrically insulating material for dispersion of the precipitated resin particles.

The metal salt (D) used in the present invention is a metal salt of a mixture consisting of carboxylic acids represented by a general formula $C_nH_{2n-1}COOH$ where n is an integer of 8 to 22, which includes mainly a saturated carboxylic acid having a five-membered ring and a saturated carboxylic acid having a plurality of ring structures. The metal salt (D) serves to control the polarity of the charge of the toner particles and is effective for improving the flow of the images and for improving the image density. It should be noted, however, that, if the carboxylic acid has a molecular weight smaller than 240, the amount of charge is insufficient in some cases. On the hand, if the molecular weight is 360 or more, the metal salt (D) tends to impair the electrical conductivity of the liquid composition in some cases.

The solvent used in the present invention for dissolving the ethylene-based copolymer resin is required to be capable of dissolving the resin in the heating step and substantially incapable of dissolving the resin at room temperature. In addition, a difference between the solubility of the copolymer resin in the solvent at 25!n and that at 60° C. should be at least 0.1 g/100 g of the solvent, preferably, at least 1 g/100 g of the solvent. Further, it is necessary to adjust the SP value of the solvent in order to control as desired the particle diameter of the precipitated resin particles. The diameter of the resin particles can be diminished with decrease in the difference &$SP between the SP value of the resin itself and that of the solvent. The solvent used in the present invention includes, for example, a linear or branched aliphatic hydrocarbon, an aromatic hydrocarbon, and a linear or branched aliphatic alcohol having at most 10 carbon atoms. These solvents can be used singly or in the form of a mixture of a plurality of these solvents.

(Function)

The surfactant represented by formula (1) has been found to produce the effect of dispersing the toner particles, making it possible to moderate the excessively high agglomerating force among the toner particles and to allow the toner particles to be consolidated sufficiently. It follows that images having a high concentration of the solid components can be obtained in the developing section. In other words, the images formed on the surface of the photosensitive body consist of toner particles stacked at a high density. As a result, the surfactant produces the effect of suppressing the disturbance of the images such as bleeding in the step of transferring the images from the surface of the photosensitive body onto, for example, a paper sheet. It should also be noted that the high concentration of the solid components in the images produces a merit that it is possible to increase the image density on the paper sheet.

Further, the toner particles are dispersed at a high stability in the liquid toner composition produced by the method of the present invention, though the composition contains a high concentration of the solid components. It follows that the preparation and handling of a concentrated toner composition can be facilitated.

Further, the SP value of the solvent for dissolving the ethylene-based copolymer resin is controlled in the present invention so as to vary the affinity between the solvent and the copolymer resin. As a result, it is possible to control as desired the particle diameter of the precipitated resin particles. It has been found that the particle diameter of the precipitated resin particles is enlarged with increase in the difference ΔSP between the SP values of the ethylene-based copolymer resin and the solvent.

Still further, the metal salt (D) is used in the present invention in combination with the surfactant (C), said metal salt (D) acting as a polarity controller of the toner particles. It has been experimentally confirmed that addition of the metal salt (D) permits ensuring the required charged amount of the toner particles and stability of the charging so as to improve the image quality, though the reasons for the particular effect have not yet been clarified.

As described above, the present invention provides a liquid toner composition containing resin particles having optionally controlled particle diameter and a narrow particle size distribution, said composition making it possible to increase the image density and eliminate bleeding of the image so as to improve the image quality. The present invention also provides a method of manufacturing the particular liquid toner composition.

EXAMPLES

Let us describe some Examples of the present invention. The expressions "parts" and "%" in the following Examples represent "parts by weight" and "% by weight", respectively.

In the following Examples, the particle diameter was measured by a laser diffraction/scattering type particle size distribution meter LA-700 manufactured by Horiba Seisakusho Ltd. The image density was measured by using a Macbeth densitometer. For measuring the bleeding of the image, the formed image was copied on a coated paper sheet available on the market by using a wet electrophotographic copying machine available on the market, and the bleeding of the copied image was visually evaluated. Further, for measuring the concentration of the solid components on the surface of the photosensitive body, the copying machine was stopped, and the image before transfer onto a paper sheet was promptly peeled off the surface of the photosensitive body so as to be dried at 110° C. for 2 hours. The concentration was determined from the difference in weight of the image between the value before the drying and the value after the drying.

For evaluating the electrical characteristics of the toner, the zeta potential was measured by using LEZA-600 (trade name of a laser zeta static charge gauge manufactured by Otsuka Densi K.K.). Further, the electrical conductivity of the liquid was measured by using a liquid toner containing 3% of the solid components. Specifically, the conductivity was measured by a DC measurement using a cell in which a universal electrometer MMAII-17A manufactured by a Kawaguchi Denki K.K. and a circular electrode (SUS 304) having a diameter of 2 cm were held stationary 1 cm apart from each other.

Example 1

Put in a container equipped with a stirrer, a thermometer and a reflux condenser were 72 parts of Isopar G (trade name of a branched aliphatic hydrocarbon produced by Exxon Inc.) and 30 parts of toluene produced by Katayama Kagaku K.K. so as to prepare a nonaqueous solvent having an SP value of 9.18. Then, put in the resultant solvent were 2 parts by Dumiran C-2280 (trade name of a partially saponified ethylene-vinyl acetate copolymer manufactured by Takeda Yakuhin Inc.), 0.4 part of phthalocyanine blue (colorant) manufactured by Dainichi Seika Kogyo K.K., and 0.24 part of a surfactant having the general formula (1), where R is a distyrylphenyl group and n=8. The resultant mixture was stirred at 70° C. for one hour so as to dissolve Dumiran completely, followed by cooling the solution to 25° C. over 180 minutes so as to permit precipitation of colored resin particles. These resin particles were found to have an average particle diameter of 2.70 μm. The mixed solvent of the resin particle dispersion was replaced by an Isopar G, followed by adding zirconium naphthenate to the dispersion as an electrically charging agent so as to obtain a positively charged liquid toner composition containing 3% of the solid components and having the charging agent uniformly dispersed therein. The properties of the toner and the results of evaluation of the image quality are shown in Table 1.

TABLE 1

| | SARFACTNAT | | | | |
|---|---|---|---|---|---|
| | R IN FORMULA (1) | n IN FORMULA (1) | PARTICLE CLIOMETER μm | POLANITY OF CHARGED PARTICLES | IMAGE DENSITY D |
| EXAMPLE 1 | DISTYRYLPHENYL | 8 | 2.70 | POSITIVE | 1.5 |
| COMPARATIVE EXAMPLE 1 | — | — | 2.81 | POSITIVE | 1.2 |
| EXAMPLE 2 | DINONYLPHENYL | 7 | 2.33 | POSITIVE | 1.5 |
| EXAMPLE 3 | DINONYLPHENYL | 7 | 7.90 | POSITIVE | 1.4 |
| EXAMPLE 4 | DISTYRYLPHENYL | 4 | 3.24 | POSITIVE | 1.4 |
| COMPARATIVE EXAMPLE 2 | DISTYRYLPHENYL | 2 | 4.71 | POSITIVE | 1.2 |
| EXAMPLE 5 | DISTYRYLPHENYL | 8 | 2.60 | POSITIVE | 1.4 |
| EXAMPLE 6 | DISTYRYLPHENYL | 8 | 2.48 | NEGATIVE | 1.4 |
| COMPARATIVE EXAMPLE 3 | DISTYRYLPHENYL | 15 | 2.53 | NEGATIVE | 1.0 |

| | CONCENTRATION(%) OF SOLID COMPONENTS ON THE SURFACE OF PHOTOSENSITIVE BODY | BLEEDING OF IMAGE | IMAGE QUALITY |
|---|---|---|---|
| EXAMPLE 1 | 14 | NONE | EXCELLENT |
| COMPARATIVE EXAMPLE 1 | 10 | SLIGHTLY OBSERVED | POOR |
| EXAMPLE 2 | 15 | NONE | EXCELLENT |
| EXAMPLE 3 | 14 | NONE | FAIR |
| EXAMPLE 4 | 13 | NONE | GOOD |
| COMPARATIVE EXAMPLE 2 | 10 | SLIGHTLY OBSERVED | FAIR |
| EXAMPLE 5 | 14 | NONE | GOOD |
| EXAMPLE 6 | 14 | NONE | GOOD |
| COMPARATIVE EXAMPLE 3 | 8 | SLIGLITLY OBSERVED | POOR |

Comparative Example 1

A liquid toner composition was prepared as in Example 1, except that a surfactant was not used in Comparative Example 1. Table 1 also shows the properties of the toner and the results of evaluation of the image quality.

Example 2

A liquid toner composition was prepared as in Example 1, except that 0.24 part of a surfactant having the general formula (1), where R is a dinonylphenyl group and n=7 was used in place of the surfactant used in Example 1. Table 1 also shows the properties of the toner and the results of evaluation of the image quality.

Example 3

A liquid toner composition was prepared as in Example 2, except that a nonaqueous solvent having an SP value of 10.73, which was prepared by adding 45 parts of Isopar G and 30 parts of toluene to ethanol, was used in place of the nonaqueous solvent having an SP value of 9.18, which was used in Example 2. Table 1 also shows the properties of the toner and the results of evaluation of the image quality.

Example 4

A liquid toner composition was prepared as in Example 1, except that 0.24 part of a surfactant represented by general formula (1), in which R is a distyrylphenyl group and n=4, was used in place of the surfactant used in Example 1, and 0.4 part of Carmin B6 (trade name of a colorant manufactured by Dainichi Seika Kogyo K.K.) was used in place of phthalocyanine used in Example 1. Table 1 also shows the properties of the toner and the results of evaluation of the image quality.

Comparative Example 2

A liquid toner composition was prepared as in Example 4, except that 0.24 part of a surfactant having the general formula (1), where R is a distyrylphenyl group and n=2 was used in place of the surfactant used in Example 4. Table 1 also shows the properties of the toner and the results of evaluation of the image quality.

Example 5

A liquid toner composition was prepared as in Example 1, except that 2 parts of Evarex 220 (trade name of ethylene-vinyl acetate copolymer resin manufactured by Mitsui Du Pont Chemical Inc.) was used in place of the ethylene-based copolymer used in Example 1, and 0.4 part of Carmin B6 was used in place of phthalocyanine used as a colorant in Example 1. Table 1 also shows the properties of the toner and the results of evaluation of the image quality.

Example 6

Put in a container equipped with a stirrer, a thermometer and a reflux condenser were 48 parts of Isopar G (trade name of a branched aliphatic hydrocarbon produced by Exxon Inc.), 48 parts of toluene as an aromatic hydrocarbon, and 30 parts of ethanol as an aliphatic alcohol so as to prepare a nonaqueous solvent having an SP value of 9.18. Then, put in the resultant solvent were 2 parts by Dumiran C-2280 (trade name of a partially saponified ethylene-vinyl acetate copolymer having an SP value of 8.93 and manufactured by Takeda Yakuhin Inc.), and 0.4 part of benzidine yellow (colorant) manufactured by Dainichi Seika Kogyo K.K. The resultant mixture was stirred at 70° C. for one hour so as to dissolve Dumiran completely, followed by cooling the solution to 25° C. over 180 minutes so as to permit precipitation of colored resin particles. The mixed solvent of the resin particle dispersion was replaced by an Isopar G, followed by adding zirconium octylate as an electrically charging agent and a surfactant represented by the general formula (1), in which R is a distyrylphenyl group and n=13, to the dispersion so as to obtain a negatively charged liquid toner composition containing 3% of the solid components and having the charging agent and surfactant uniformly dispersed therein. The properties of the toner and the results of evaluation of the image quality are shown in Table 1.

Comparative Example 3

A liquid toner composition was prepared as in Example 6, except that 0.24 part of a surfactant having the general formula (1), where R is a distyrylphenyl group and n=15 was used in place of the surfactant used in Example 6. The surfactant was found not to be dissolved sufficiently in Isopar G, resulting in failure to obtain a dispersion effect of the surfactant. Table 1 also shows the properties of the toner and the results of evaluation of the image quality.

If the liquid toner composition of the present invention is used for electrophotography, the surfactant represented by general formula (1) produces a sufficient dispersion effect so as to improve the consolidation property of the toner particles. As a result, images having a high concentration of the solid components, in which the toner particles are stacked at a high density, are formed on the surface of the photosensitive body, making it possible to suppress bleeding of images in the transferring step of the toner from the photosensitive body to a paper sheet. It is also possible to increase the optical density of the images on the paper sheet.

Also, in manufacturing the liquid toner composition of the present invention, the SP value of the solvent for dissolving the ethylene-based copolymer resin is adjusted so as to vary the affinity between the solvent and the copolymer resin. As a result, the diameter of the precipitated resin particles can be optionally controlled.

Example 7

Put in a container equipped with a stirrer, a thermometer and a reflux condenser were 72 parts of Isopar G (trade name of a branched aliphatic hydrocarbon produced by Exxon Inc.), 48 parts of toluene as an aromatic hydrocarbon, and ethanol as an aliphatic alcohol so as to prepare a nonaqueous solvent having an SP value of 9.18. Then, put in the resultant solvent were 2 parts by Dumiran C-2280 (trade name of a partially saponified ethylene-vinyl acetate copolymer having an SP value of 8.93 and manufactured by Takeda Yakuhin Inc.), 0.4 part of phthalocyanine blue (colorant) manufactured by Dainichi Seika Kogyo K.K., and 0.24 part of a surfactant represented by the general formula (1), in which R is a distyrylphenyl group, and n=8. The resultant mixture was stirred at 70!n for one hour so as to dissolve Dumiran completely, followed by cooling the solution to room temperature over 180 minutes so as to permit precipitation of colored resin particles.

The colored toner particles were found to have an average diameter of 1.84 μm. The mixed solvent of the resin particle dispersion was replaced by an Isopar G, followed by adding zirconium salts of carboxylic acid mixture having an average molecular weight of 350 as a polarity suppressing agent so as to obtain a liquid toner composition in the form of a dispersion. The properties of the toner and the results of evaluation of the image quality are shown in Table 2.

TABLE 2

| | SARFACTANT | | | | | | |
|---|---|---|---|---|---|---|---|
| | R IN FORMULA | n IN FORMULA | SCRPPRESING AGENT | | TONER DIAMETER | ZETA POTENTIAL | CONDUCTIVITY |
| | (1) | (1) | | METAL | μm | mV | S/cm × $10^{-12}$ |
| EXAMPLE 7 | DISTYRYLPHENYL | 8 | 350 | Zr | 1.84 | +103 | 7.2 |
| EXAMPLE 8 | DISTYRYLPHENYL | 8 | 250 | Zr | 1.84 | +82 | 6.6 |
| COMPARATIVE EXAMPLE 4 | — | — | 350 | Zr | 2.81 | +105 | 7.1 |
| COMPARATIVE EXAMPLE 5 | DISTYRYLPHENYL | 8 | 380 | Zr | 1.84 | +107 | 15 |
| COMPARATIVE EXAMPLE 6 | DISTYRYLPHENYL | 8 | 195 | Zr | 1.84 | +43 | 6.8 |
| EXAMPLE 9 | DISTYRYLPHENYL | 8 | 300 | Co | 1.84 | +78 | 6.4 |
| EXAMPLE 10 | DISTYRYLPHENYL | 8 | 300 | Ba | 1.84 | +111 | 7.0 |
| EXAMPLE 11 | DINOYLPHENEL | 7 | 350 | Zr | 2.35 | +98 | 6.9 |
| COMPARATIVE EXAMPLE 7 | DINOYLPHENEL | 7 | 350 | Zr | 50.3 | — | — |
| EXAMPLE 12 | OCTYLPHENYL | 13 | 300 | Zn | 2.24 | +87 | 6.4 |
| EXAMPLE 13 | NONYLPHENYL | 4 | 300 | Ca | 2.28 | +75 | 8.3 |
| COMPARATIVE EXAMPLE 8 | NONYLPHENYL | 3 | 300 | Ca | 2.46 | +72 | 8.7 |
| COMPARATIVE EXAMPLE 9 | NONYLPHENYL | 14 | 300 | Ca | 2.73 | +70 | 8.6 |

TABLE 2-continued

| | IMAGE DENSITY D | CONCENTRATION(wt %) OF SOLID COMPONENTS ON THE SURFACE OF PHOTOSENSITIVE BODY | FLOW OF IMAGE | BLEEDING OF IMAGE | IMAGE QUALITY |
|---|---|---|---|---|---|
| EXAMPLE 7 | 1.5 | 14 | NONE | NONE | EXCELLENT |
| EXAMPLE 8 | 1.5 | 14 | NONE | NONE | EXCELLENT |
| COMPARATIVE EXAMPLE 4 | 1.2 | 9 | *1 | SLIGHTLY OBSERVED | POOR |
| COMPARATIVE EXAMPLE 5 | 1.4 | 13 | OBSERVED | NONE | POOR |
| COMPARATIVE EXAMPLE 6 | 1.0 | 10 | OBSERVED | SLIGHTLY OBSERVED | POOR |
| EXAMPLE 9 | 1.4 | 12 | NONE | NONE | GOOD |
| EXAMPLE 10 | 1.4 | 13 | NONE | NONE | GOOD |
| EXAMPLE 11 | 1.5 | 15 | NONE | NONE | EXCELLENT |
| COMPARATIVE EXAMPLE 7 | — | — | — | — | — |
| EXAMPLE 12 | 1.4 | 16 | NONE | NONE | EXCELLENT |
| EXAMPLE 13 | 1.3 | 12 | NONE | NONE | GOOD |
| COMPARATIVE EXAMPLE 8 | 1.1 | 10 | SLIGHTLY OBSERVED | SLIGHTLY OBSERVED | POOR |
| COMPARATIVE EXAMPLE 9 | 1.0 | 6 | OBSERVED | OBSERVED | POOR |

*1 Flow of image was observed where the image density D was 1.2 or more.

FIG. 1 is a graph showing the particle size distribution covering the toner particles prepared in Example 7. Plotted on the ordinate on the right hand side of the graph is an accumulated percentage (R %) of the particles, which is denoted by a curve. On the other hand, plotted on the ordinate on the left hand side of the graph are the frequency percentages (F %) of the particles having diameters plotted on the abscissa, which are denoted by bars. The median diameter, i.e., particle diameter at the point where the accumulated percentage of the particles is 50%, denotes an average particle diameter, which was found to be 1.843 $\mu$m. Also, the specific surface area, i.e., the surface area of the particles occupying a volume of 1 $cm^3$, was found to be 49400 $cm^2/cm^3$. As apparent from FIG. 1, the toner particle having a diameter of 10 $\mu$m or more was not contained at all in the liquid toner composition prepared in Example 7. Also, the curve in FIG. 1 indicates that the liquid toner composition prepared in Example 7 contains 90% of the toner particles having a diameter of 1.116 $\mu$m or more.

Example 8

A liquid toner composition was prepared as in Example 7, except that zirconium salt of a carboxylic acid mixture having an average molecular weight of 250 was added in place of the polarity suppressing agent (component D) used in Example 7. Table 2 also shows the properties of the toner and the results of evaluation of the image quality.

Comparative Example 4

A liquid toner composition was prepared as in Example 7, except that the surfactant (C) used in Example 7 was not added in Comparative Example 4. Table 2 also shows the properties of the toner and the results of evaluation of the image quality.

Comparative Example 5

A liquid toner composition was prepared as in Example 7, except that zirconium salt of a carboxylic acid mixture having an average molecular weight of 380 was used in place of the polarity suppressing agent (D) used in Example 7. Table 2 also shows the properties of the toner and the results of evaluation of the image quality.

Comparative Example 6

A liquid toner composition was prepared as in Example 7, except that zirconium salt of a carboxylic acid mixture having an average molecular weight of 195 was used in place of the polarity suppressing agent (D) used in Example 7. Table 2 also shows the properties of the toner and the results of evaluation of the image quality.

Example 9

A liquid toner composition was prepared as in Example 7, except that zirconium salt of a carboxylic acid mixture having an average molecular weight of 300 was used in place of the polarity suppressing agent (D) used in Example 7. Table 2 also shows the properties of the toner and the results of evaluation of the image quality.

Example 10

A liquid toner composition was prepared as in Example 7, except that barium salt of a carboxylic acid mixture having an average molecular weight of 300 was used in place of the polarity suppressing agent (D) used in Example 7. Table 2 also shows the properties of the toner and the results of evaluation of the image quality.

Example 11

A liquid toner composition was prepared as in Example 7, except that 0.24 part of the compound represented by general formula (1), in which R is a dinonylphenyl group and n=7, was used in place of the surfactant (C) used in Example 7, and that 0.4 part of Carmin B6 manufactured by Dainichi Seika Kogyo K.K. was used as a colorant in place of phthalocyanine blue used in Example 7. Table 2 also shows the properties of the toner and the results of evaluation of the image quality.

Comparative Example 7

A liquid toner composition was prepared as in Example 7, except that 150 parts of toluene was used in place of the mixed solvent of Isopar G/toluene/ethanol used in Example 7. The precipitated red toner particles were found to have an excessively large particle diameter, i.e., an average particle diameter of 50.3 μm. Naturally, it is undesirable for these large toner particles to be contained in a liquid toner composition.

Figure 2:
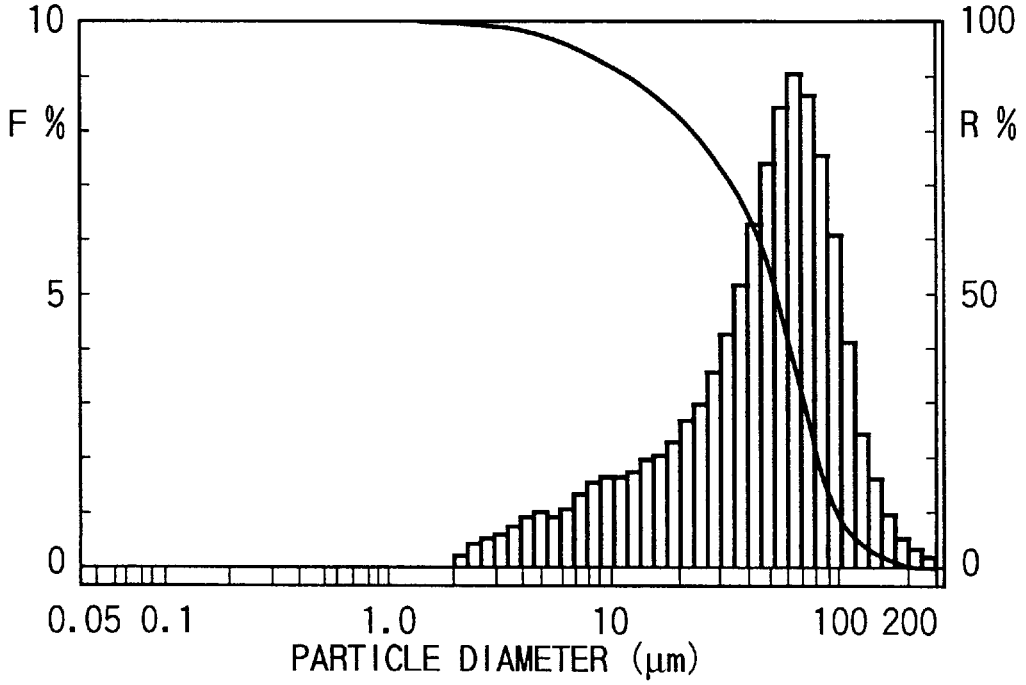
FIG. 2 is a graph showing the particle size distribution of the toner particles obtained in Comparative Example 4.

FIG. 2 is a graph showing the particle size distribution covering the toner particles prepared in Comparative Example 7. Plotted on the ordinate on the right hand side of the graph is an accumulated percentage (R %) of the particles, which is denoted by a curve, as in FIG. 1. On the other hand, plotted on the ordinate on the left hand side of the graph are the frequency percentages (F %) of the particles having diameters plotted on the abscissa, which are denoted by bars. The median diameter, i.e., particle diameter at the point where the accumulated percentage of the particles is 50%, denotes an average particle diameter, which was found to be 50.317 μm. Also, the specific surface area, i.e., the surface area of the particles occupying a volume of 1 $cm^3$, was found to be 2513 $cm^2/cm^3$. As apparent from FIG. 2, the toner particles having a diameter of 10 μm or more were found to occupy 90% of all the toner particles in the liquid toner composition prepared in Comparative Example 7. Also, the curve in FIG. 2 indicates that the liquid toner composition prepared in Comparative Example 7 contains 90% of the toner particles having a diameter of at least 9.961 μm.

Example 12

A liquid toner composition was prepared as in Example 7, except that 0.24 part of the compound represented by general formula (1), in which R is an octylphenyl group and n=13, was used in place of the surfactant (C) used in Example 7, and that zinc salt of a carboxylic acid mixture having an average molecular weight of 300 was used as the polarity suppressing agent. Table 2 also shows the properties of the toner and the results of evaluation of the image quality.

Example 13

A liquid toner composition was prepared as in Example 7, except that 0.24 part of the compound represented by general formula (1), in which R is an nonylphenyl group and n=4, was used in place of the surfactant (C) used in Example 7, that calcium salt of a carboxylic acid mixture having an average molecular weight of 300, said calcium salt being used as a polarity suppressing agent, was precipitated on the surface of the toner particle, and that the mixed solvent was added after replacement by Isopar G. Table 2 also shows the properties of the toner and the results of evaluation of the image quality.

Comparative Example 8

A liquid toner composition was prepared as in Example 13, except that 0.24 part of the compound represented by general formula (1), in which R is an nonylphenyl group and n=3, was used in place of the surfactant (C) used in Example 13. Table 2 also shows the properties of the toner and the results of evaluation of the image quality.

Comparative Example 9

A liquid toner composition was prepared as in Example 13, except that 0.24 part of the compound represented by general formula (1), in which R is an nonylphenyl group and n=14, was used in place of the surfactant (C) used in Example 13. The surfactant used in this experiment was found to be incapable of being dissolved completely in Isopar G, failing to exhibit a sufficient dispersion effect. Table 2 also shows the properties of the toner and the results of evaluation of the image quality.

As described above, the surfactant (C) contained in the liquid toner composition of the present invention produces a dispersion effect so as to improve the consolidation property of the toner particles, making it possible to obtain on the surface of the photosensitive body images having a high concentration of the solid components, in which the toner particles are stacked one upon the other at a high density. It follows that it is possible to suppress collapse and bleeding of images in the toner transfer step from the surface of the photosensitive body onto a paper sheet. Also, a metal salt of a carboxylic acid mixture can be used as a polarity suppressing agent (D) in combination with the surfactant (C) so as to stabilize the polarity and charging of the toner particles. Further, the SP value of the solvent used for dissolving the ethylene-based copolymer resin is adjusted in the manufacturing method of the liquid toner composition of the present invention so as to vary the affinity between the solvent and the copolymer resin. As a result, the diameter of the precipitated resin particles can be controlled as desired.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A liquid toner composition, comprising an ethylene-based copolymer resin, an electrically insulating liquid material, and a surfactant represented by general formula (1) given below:

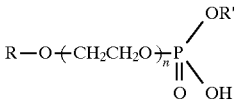

(1)

where R is an alkyl group or an alkylaryl group, n, which represents an adduct ethleneoxide mole number, which is an integer of 4 to 13, and R' is H or $R(CH_2CH_2O)_n$ group.

2. The liquid toner composition according to claim 1, wherein a colorant is added in advance to said ethylene-based copolymer resin.

3. The liquid toner composition according to claim 1, wherein said electrically insulating liquid material has a resistivity of at least $10^9$ Ω·cm and a dielectric constant of at most 3.0.

4. The liquid toner composition according to claim 1, comprising at least components (A) to (D) given below:

(A) a nonpolar liquid material having an electrical resistivity of at least $10^9$ Ω·cm and a dielectric constant of at most 3.0, (B) particles of an ethylene-based resin or a colorant-added ethylene-based resin, which are insoluble in the nonpolar liquid material (A) at 50° C. or less and have a volume-based average particle diameter of at most 15 μm, (C) a surfactant represented by the general formula, and (D) metal salt of a mixture consisting of a saturated carboxylic acid having a five-membered ring and a saturated carboxylic acid having a plurality of ring structures, each of these carboxylic acids having an average molecular weight of 240 to 360 and having a compatibility with the nonpolar liquid material (A).

5. The liquid toner composition according to claim 4, wherein the metal of said metal salt is selected from the group consisting of Co, Ca, Zn, Zr and Ba.

6. A method of manufacturing a liquid toner composition defined in claim 1, comprising the steps of:

(a) dissolving under heat an ethylene-based copolymer resin or a colorant-added ethylene-based copolymer resin in a solvent having a high temperature dependency in its capability of dissolving said copolymer resin and having its solubility parameter SP adjusted to control as desired the diameter of the toner particles;

(b) cooling the resultant solution to precipitate toner particles; and (c) replacing said solvent with an electrically insulating liquid material so as to disperse the precipitated toner particles in said liquid material, wherein said steps (a) to (c) are carried out in the presence of a surfactant represented by general formula (1).

7. A method of manufacturing a liquid toner composition defined in claim 1, comprising the steps of:

(a) dissolving under heat an ethylene-based copolymer resin or a colorant-added ethylene-based copolymer resin in a solvent having a high temperature dependency in its capability of dissolving said copolymer resin and having its solubility parameter SP adjusted to control as desired the diameter of the toner particles;

(b) cooling the resultant solution to precipitate particles (B) given below; and (c) replacing said solvent with a nonpolar liquid material (A) given below so as to disperse the precipitated particles in said nonpolar liquid material, wherein said steps (a) to (c) are carried out in the presence of a surfactant (C) given below and/or a metal salt (D) given below:

(A) a nonpolar liquid material having an electrical resistivity of at least $10^9$ Ω·cm and a dielectric constant of at most 3.0, (B) particles of an ethylene-based resin or a colorant-added ethylene-based resin, which are insoluble in the nonpolar liquid material (A) at 50° C. or less and have a volume-based average particle diameter of at most 15 μm, (C) a surfactant represented by general formula, and (D) metal salt of a mixture consisting of a saturated carboxylic acid having a five-membered ring and a saturated carboxylic acid having a plurality of ring structures, each of these carboxylic acids having an average molecular weight of 240 to 360 and having a compatibility with the nonpolar liquid material.

* * * * *